United States Patent [19]

Muller

[11] 4,188,980

[45] Feb. 19, 1980

[54] LUBRICATING MEANS FOR RECIPROCATING FILLING-YARN INSERTERS

[75] Inventor: Kurt Müller, Friedrichshafen, Del.X

[73] Assignee: Lindauer Dornier Gesellschaft mbH., Fed. Rep. of Germany

[21] Appl. No.: 934,273

[22] Filed: Aug. 16, 1978

[30] Foreign Application Priority Data

Sep. 27, 1977 [DE] Fed. Rep. of Germany ..... 2743303

[51] Int. Cl.[2] ..... D03J 1/00

[52] U.S. Cl. ..... 139/1 R; 139/45; 139/449

[58] Field of Search ..... 139/1 R, 45, 449; 184/1 E, 5, 15 R, 100; 308/240

[56] References Cited

U.S. PATENT DOCUMENTS

| | | | |
|---|---|---|---|
| 3,583,774 | 6/1971 | De Gast | 184/5 |
| 3,590,957 | 7/1971 | Campbell | 184/1 E |
| 4,044,802 | 8/1977 | Steverlnck | 139/449 |
| 4,046,224 | 9/1977 | Smutny | 139/45 |

*Primary Examiner*—Henry Jaudon

*Attorney, Agent, or Firm*—James E. Bryan

[57] ABSTRACT

This invention relates to an improvement in a weaving machine with filling-yarn insertion by means of inserters adapted to be alternatingly advanced into and retracted from the shed and being composed of long support devices having gripper systems at the ends thereof, said support devices being adapted to be driven and both supported and guided outside the shed in their rectilinear motion, and being supported between guide rollers, the improvement comprising solid lubricating means fixed with respect to the machine and in contact with said support devices in an unstressed part of bearing means for said support devices.

14 Claims, 8 Drawing Figures

LUBRICATING MEANS FOR RECIPROCATING FILLING-YARN INSERTERS

This invention relates to shuttleless weaving machines comprising filling-yarn inserters which are alternatingly advanced into and retracted from the shed. The filling yarn is taken off quills outside the shed and gripped at its free ends by gripping systems. These gripping systems are mounted at the tip of support devices by means of which they are advanced into or retracted from the shed.

Various designs are known for the gripping systems and their support devices. One type uses long rods or needles with the gripping systems for holding and transferring the filling yarn at their ends. These rod-like support devices must be fairly stiff and are frequently mounted on carriages. They are actuated through these by means of levers with crankdrives and rods. Ordinarily, these rod-like support devices take the form of tubing or hollow square sections. On that account some designs place gear-racks inside the hollow support devices and the drive is implemented by meshing pinions alternating in direction.

Again, in other designs, the support devices are composed of flexible strips to the ends of which are mounted the gripper systems. These strips are required to offer some stiffness and are wound on large discs driven in alternating directions.

Great care must be given in all such support devices of gripping systems regarding both bearing and guidance. Very often slide guides for the support devices are provided outside the shed, possibly however also extending somewhat into the shed, especially in the case of the flexible strips. As regards the rod-like support devices with pinion drive, the rods are polygonal, preferably rectangular in cross-section and are guided outside the shed. Roller guidance is most often provided in this case, the planar sides of the support devices always resting against one or more rollers. In this instance the pinion drive is mounted in the vicinity of the guide rollers.

However, lubrication is required for proper guidance of the support devices. On the other hand, lubrication with oil or grease is impermissible in most cases in order to prevent soiling of the finished fabric. Attempts to put solid lubricating glides, for instance teflon, into the guides failed to be satisfactory on account of the poor thermal conductivity and the ensuing temperature rise in these guides. Because of the high rates of filling-yarn insertion, premature wear occurred at the bearings, or guides, and at the reciprocating support devices. To ensure precise yarn transfer from a discharging to a receiving gripper system approximately at the center of the shed, frequent adjustment of the bearing was required. Again, roller bearings with solid lubricants undergo appreciable wear in their guide rollers and support devices, especially at reversing points of the reciprocating motion. Again, frequent adjustments, especially exchanging of rollers, are required.

The invention therefore addresses the problem of creating lubrication for the filling-yarn inserters, i.e. for the support devices of yarn gripping systems, which are free from these drawbacks and which, on account of substantially longer intervals between adjustments, facilitate operation of the weaving machine. This problem is solved by the invention in that solid lubricant systems are provided in the unloaded part of the bearing so as to remain spatially fixed with respect to the machine, and which make contact with the support devices. Suitable lubricants are known plastics such as the above-cited teflon. Appropriately the solid lubricant is so mounted that its surface touching the support devices rests against the sides of these devices at a slight pressure and in a direction perpendicular to the direction of motion of the devices. Depending upon the specific requirements, the solid lubricant body may be of separate parts, and may surround, by its cross-section, in whole or in part, the machine segment which must be lubricated. The individual parts of the solid lubricant body need not lie in a single cross-sectional plane, rather they may be mounted in several, and, depending on the requirements, both inside and outside the bearing.

The abrasion of lubricant caused by the reciprocating machine parts is introduced into the loaded bearing component and distributed thereover the entire length of the stroke. However the solid lubricant body is exposed only to the above-cited resting pressure, not to the bearing load. Because the lubrication takes place in the unstressed part of the bearing, i.e. the guide, the bearing components may be made of wear-resistant material, and no loss of bearing material takes place. This eliminates the above-cited frequent adjustment of the bearing. On the contrary, in the invention, there is even an increase in the mass of the bearing. The accuracy of such a bearing and guide therefor is ensured for a long time and remains independent of the wear of the solid lubricant body. Furthermore, the thin film of solid lubricant permits good heat conduction away from the corresponding machine parts.

Relatively hard bearing materials themselves lacking lubrication, with good thermal conductivity may be used, such as are employed in oil lubrication for instance. The continuously self-renewing thin film of solid lubricant practically is not thermally insulating, rather it permits good conduction of the bearing frictional heat from the reciprocating machine parts to the heat-sink bearing. Therefore the bearing temperature remains fairly low during operation, whereby wear is advantageously reduced. All the soiling phenomena incurred for instance in oil lubrication therefore are eliminated in the solid lubrication of the invention.

The invention will be further illustrated by reference to the accompanying drawings, in which.

Figure 1:
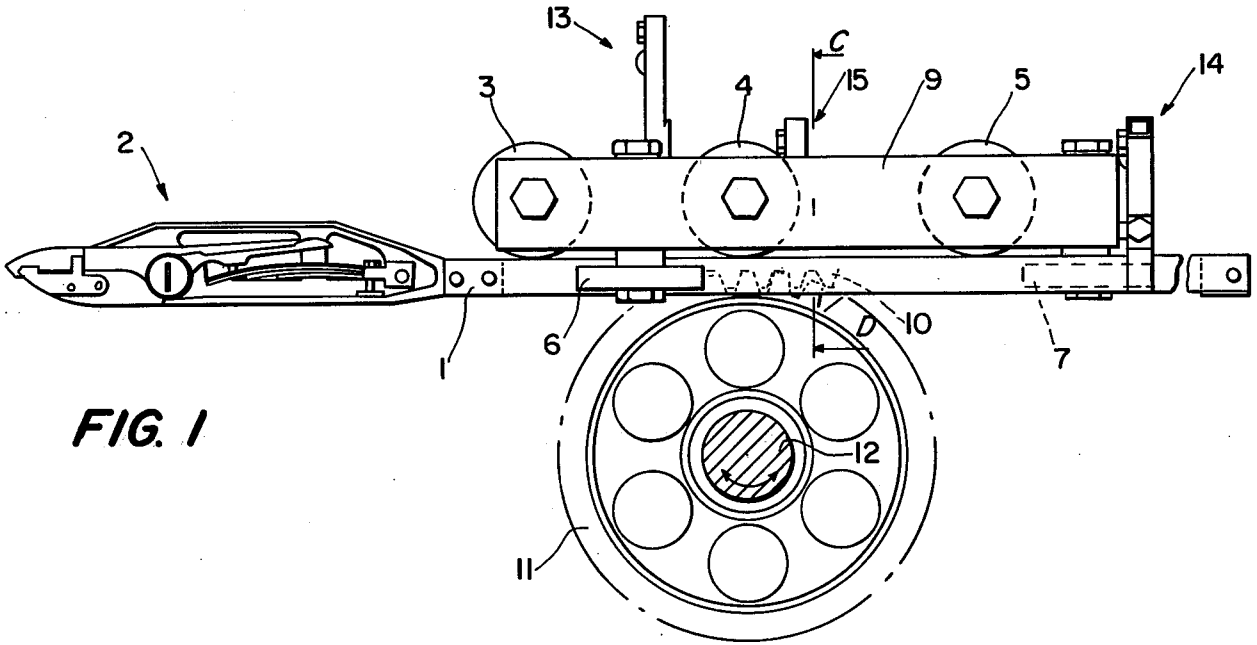
FIG. 1 is a side view of the drive and the bearing of a gripper rod.
Figure 3:
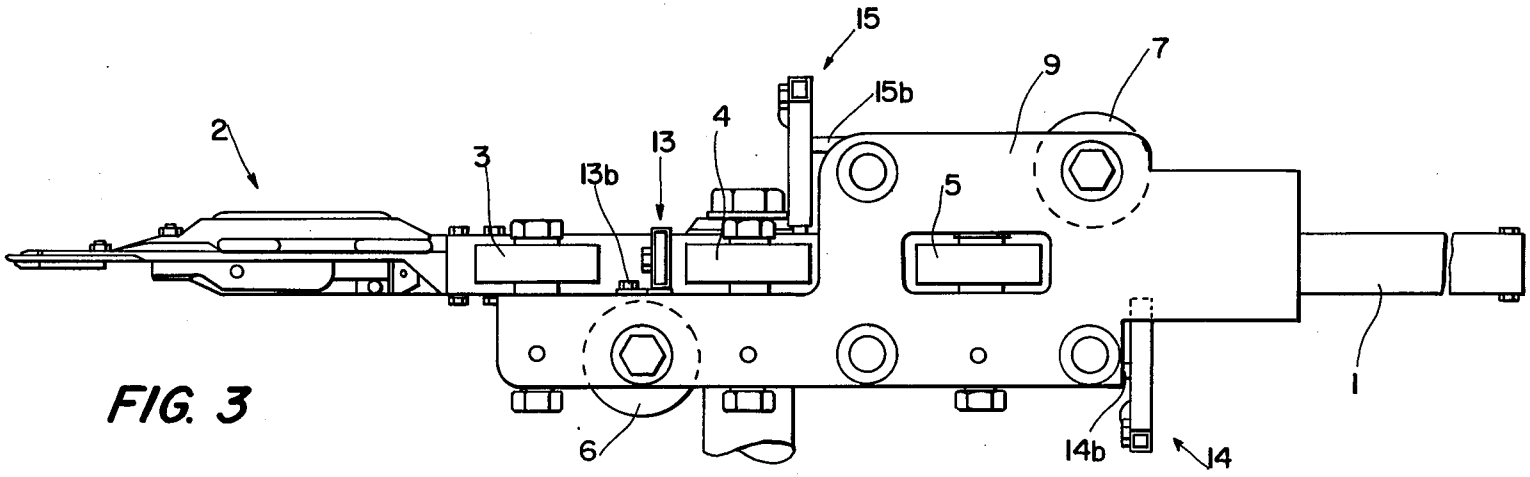
FIG. 3 is a top view of the gripper rod of FIG. 1.
Figure 2:
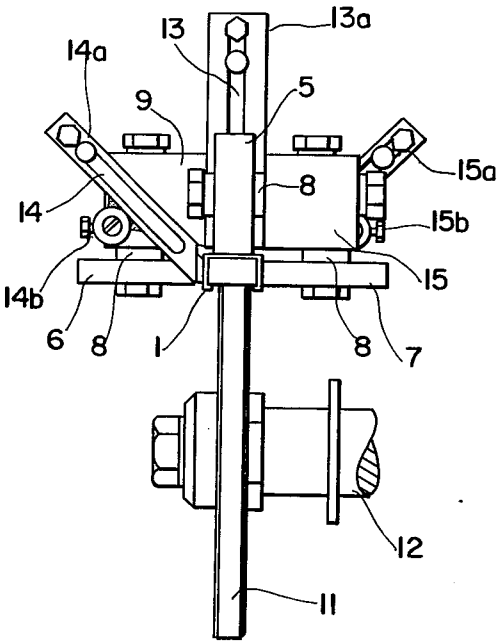
FIG. 2 is a side view of the gripper rod of FIG. 1, viewed from the right.

A gripper rod 1 is the basis of the filling yarn inserter of the embodiment in FIGS. 1 through 4; a gripper head 2 with mechanisms for seizing, holding and releasing the filling yarn is mounted on the front end of the rod. The particular design of the gripper head 2 is not significant for the invention and therefore will not be described further. The gripper rod selected for illustration in principle is composed of a U-shaped section enclosing a gear-rack 10 for drive purposes. Driving is obtained by means of a pinion 11 meshing with the gear rack 10 and in turn driven by a shaft 12 alternatingly rotating in opposite directions. The direction of rotation is indicated by an arrow in the Figure. The gripper rod 1 thereby is alternatingly advanced and retracted. The bearing and guidance of the gripper rod 1 in this embodiment are implemented by rollers. A support plate 9, fastened to the machine structure in a manner not further described, holds three guide rollers 3, 4, and 5 rotating about horizontal axes and opposite the drive pinion 11. These rollers rest as vertical guides against the horizontal cross-sectional surface of the gripper rod 1, that is, against the upper side of the rod. Lateral guidance of the gripper rod 1 is implemented by the guide rollers 6 and 7, of which the axes of rotation are vertical. All the guide rollers rest in an adjustable manner each on an eccentric pin. The gripper is slightly pressed downwardly against the bottom of the slay or against the warp threads of the lower shed by means of the guide rollers 3. The guide rollers 6 and 7 implement the positioning of the gripper in the horizontal position against the reed. In general, no use is made of the roller 5, which serves to preserve the free end of the gripper from excessive vertical flexural oscillations. When plastic grippers are used, the guide rollers ordinarily are made of steel, and vice versa, when steel gripper rods are used, the guide rollers are made of plastic.

The remaining operation of the gripper rods when inserting the filling yarn need not be discussed further herein.

Three separate parts are provided for the solid lubricant system of this embodiment, namely one part each for every one of the three sides of the U-shaped section of the gripper rod 1. A first solid lubricant body 13 for lubricating the upper side of the gripper rod section is mounted between the guide rollers 3 and 4. This solid lubricant body therefore is located at a site not stressed by the bearing forces. Two additional solid lubricant bodies 14 and 15 are mounted on the two sides of the U section of the gripper rod. They too are at sites free from bearing stresses. FIG. 1 shows that these three solid lubricant bodies are located in three different transverse planes of the gripper rod bearing. Obviously, it equally is feasible to so arrange this equipment that for instance the two lateral solid lubricant bodies 14 and 15 are located in approximately the same transverse plane or even jointly with the solid lubricant body 13 in a single one. The arrangement may be adapted to the design of the bearing of the particular machinery.

Figure 4:
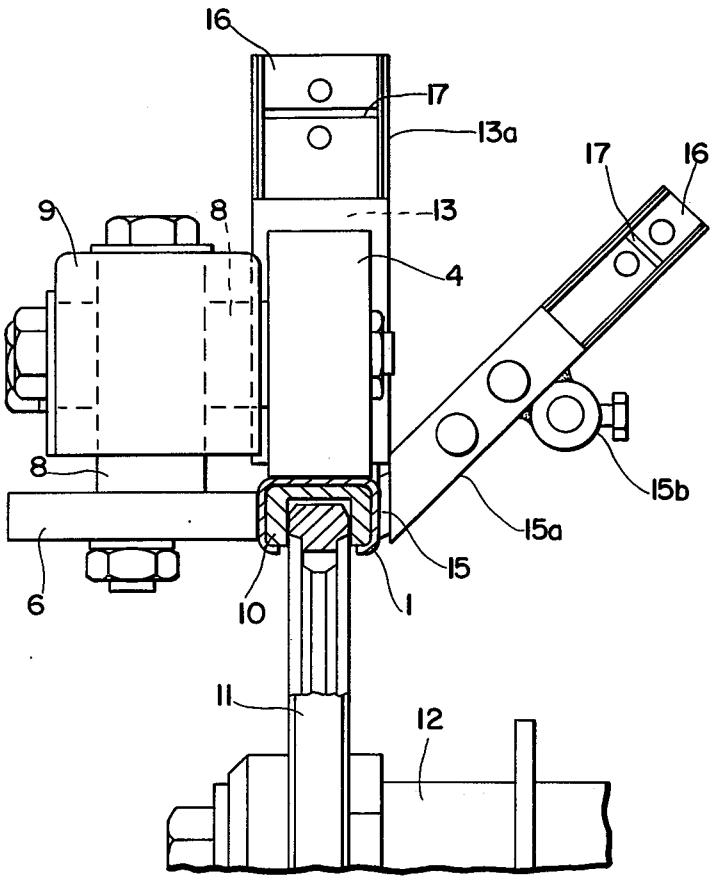
FIG. 4 is an enlargement of a section through FIG. 1 along line C–D.

In this embodiment the solid lubricant bodies are shown as flat pieces and located with a slight side play in the guide ducts 13*a*, 14*a* and 15*a*, the ducts being adjustably fastened by the screws 13*b*, 14*b*, and 15*b*, not shown in further detail, to the support plate 9. FIG. 4 indicates that the guide ducts, for instance following loosening of a screw 15*b*, can be displaced in the direction of advance of the gripper rod 1. The guide ducts and their solid lubricant bodies within are so arranged in planes transverse to the gripper rod that the bodies rest vertically on those rods sides which are associated therewith. By its own weight, the solid lubricant body 13 generates in its guide 13*a* all of the compression for lubrication. The side guide ducts 14*a* and 15*a* are slightly slanted in their transverse planes. In this manner there is also generated a horizontal force from the weights of the solid lubricant bodies on the sides of the U section, the horizontal forces in general sufficing to achieve the compression required for the lubricant body. If, however, the weight proper of the solid lubricant body were insufficient to keep it resting against the machine part to be lubricated, for instance against the gripper rod 1 and to avoid its bouncing up again, an adjustable depressing means 16 provided with a shock-attenuating layer 17 may be provided in the guide duct. In lieu of the layer 17 a small spring may also be used. In this manner the compression of the solid lubricant body on the sides of the gripper rod may be made adjustable if desired.

The width of the solid lubricant body is so selected that where it rests against the sides of the U section, it will cover at least part of the width of the section, and preferably all of it. It is thus clear that not only does the solid lubricant body adjust itself as abrasion takes place, but also that when entirely used up, it can be easily replaced by a new one.

Figure 5:
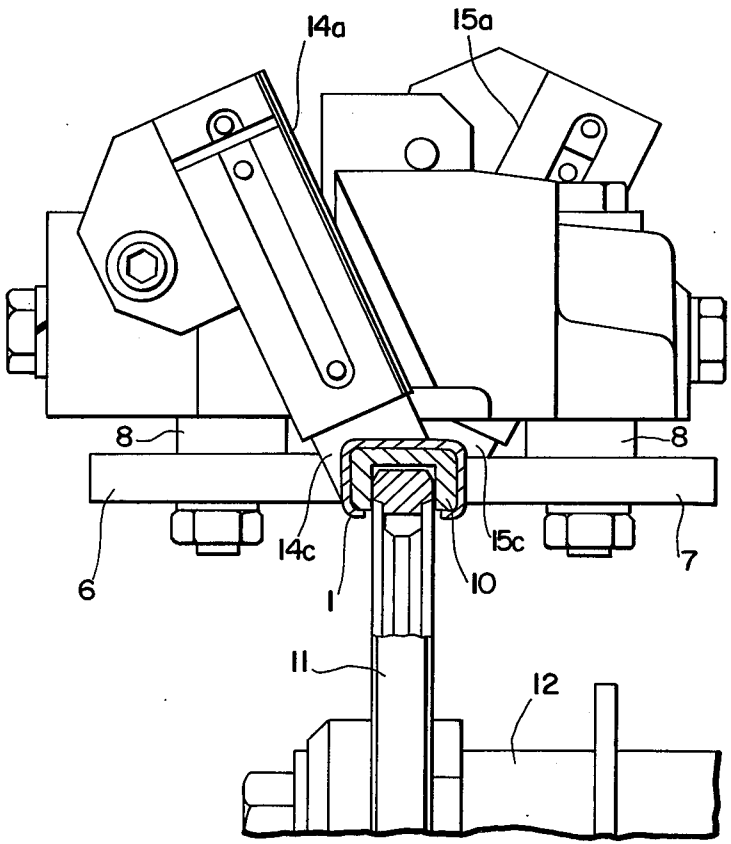
FIG. 5 is a variation of FIG. 4.

Whereas FIGS. 1 through 4 illustrate and describe an embodiment in which one solid lubricant body is provided for each of the three sides of a U section, FIG. 5 shows a variation for which a U section requires only two solid lubricant bodies. The essential parts retain the same reference numerals as in FIGS. 1 through 4. The difference is merely that only two oblique guide ducts 14*a* and 15*a* are provided, and that one vertical guide duct is eliminated. The two guide ducts are so mounted, and the flat piece within constituting a solid lubricant body 14*c* or 15*c* is wide enough that its resting surface can be made angular and thereby covers two adjacent sides of the U section. Thus the upper side of the U section of the gripper rod 1 is covered at least partly by both solid lubricant bodies 14*c* and 15*c*. In this embodiment again, the weights of the solid lubricant bodies suffice to provide the compression against the vertical and horizontal sides of the gripper rod section for adequate lubrication.

Because of the right angular resting surface of the individual solid lubricant flat pieces in the region of compression, unevennesses and vibrations in the gripper rod also act at right angles to their source and result in a short-lived lifting of the flat pieces from the gripper rod, with simultaneous interruption of solid lubricant supply to the two gripper guide surfaces. This short term interruption of lubricnt feed to at least two guide surfaces of the gripper rod simultaneously however is hardly noticeable in its effects because the guide rollers obtain their lubricant coating from the gripper, the coating in turn providing in compensating manner some of its lubricant to the gripper rod, whereby an even distribution of the solid lubricant is ensured over the entire stroke of the gripper. A depressing means with a shock-attenuating layer in this case also decreases the amount the solid lubricant body lifts off its associated side of the gripper rod.

It is apparent that the invention is not restricted to gripper rods with U-shaped cross-sections, that is, with rectangular cross-sections, and that other polygonal cross-sections are equally applicable. Again, even when polygonal cross-sections are used, a special solid lubricant body need not be provided for each side of the gripper rod, rather again adjacent sides may both be covered by an angle-shaped lubricant body. Again, curved cross-sections are not excluded from the invention where the drive and the guidance of the gripper rods permit the use of such cross-sections, and where the resting surface of the solid lubricant bodies is consequently shaped.

Figure 7:
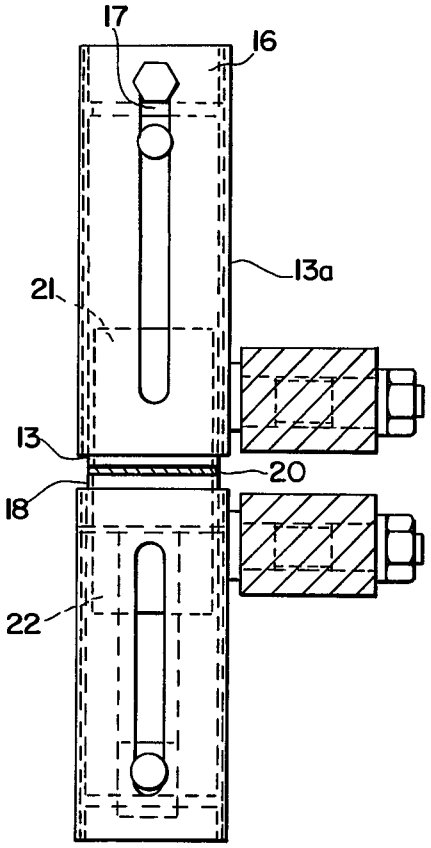
FIG. 7 is an enlarged section through FIG. 6 along line A–B of FIG. 6.
Figure 6:
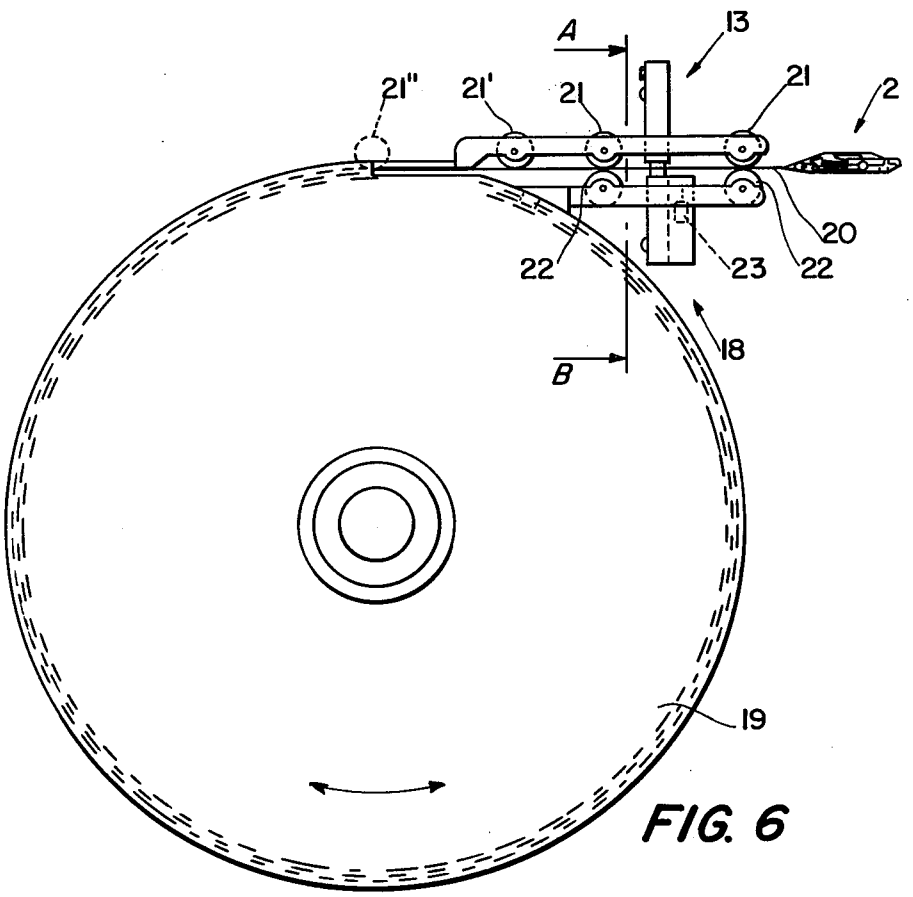
FIG. 6 is a drive and bearing of a flexible strip with gripper, in a side view.

A further embodiment of the invention is shown in FIGS. 6 and 7. In this case there are no rod-like support devices for gripper heads, rather flexible strips. Such a flexible strip 20, for instance made of spring steel, can be wound on and taken off of a large disc 19 depending upon the alternating rotations thereof, as indicated by the arrow. The strip 20 at its front end holds a gripping head 2. The upper and lower guide rollers 21 and 22 guide the strip 20. As already mentioned, these rollers also can be adjusted by means of eccentric pins. The number and the arrangement of the rollers are entirely a function of the particular requirements. In this embodiment pairs of opposite rollers 21 and 22 are provided, furthermore there is a third upper guide roller 21' adjacent the disc 19. This third roller possibly also can be mounted vertically above the axis of rotation of the disc 19, as indicated by 21''. Between the two pairs of rollers 21 and 22 is located the lubrication system, namely in a plane tranverse to the direction of advance of the strip 20. This lubrication system is composed of an upper, solid lubricant body 13, which may be similar in design to those shown in FIGS. 1 through 4, and of another solid lubricant body 18 pressing from below against the strip 20. Whereas again it is the weight of the solid lubricant body 13 which acts in compression, the pressure exerted by the lower solid lubricant body 18 must be induced by special means, for instance by a spring or by a pulley system 23 reversing its own weight. Here also the lubrication takes place outside the stressed bearing sites.

In order to avoid any undesired effects from compressions of different magnitudes on the part of the upper and lower solid lubricant bodies 13 and 18 on the strip 20, and furthermore to avert any deflection of the strip due to such pressure differences, the upper and lower bearing parts, i.e., the rollers 21 and 22 may be so offset in the direction of advance of the strip 20, that one roller 22 is opposite the solid lubricant body 13 and one roller 21 is opposite the solid lubricant body 18, thus absorbing the compression. The above cited adjustability of the bearing rollers is advantageous in this respect. It follows again there is a division of the lubrication system into separate transverse planes.

Figure 8:
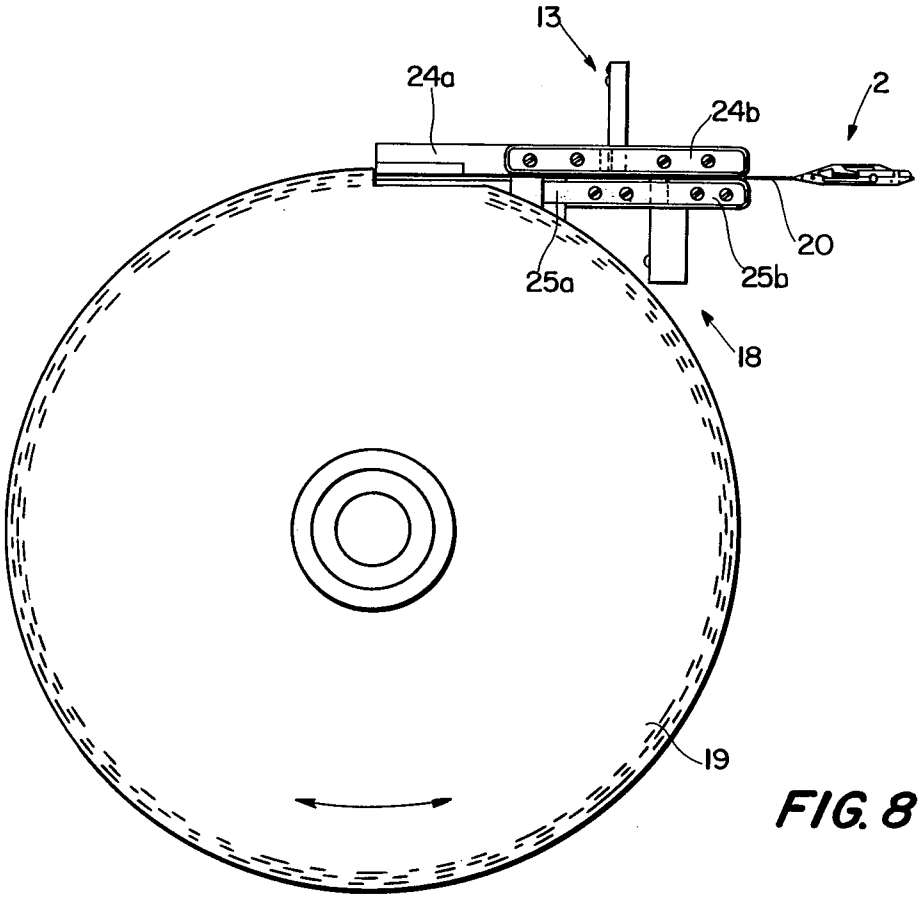
FIG. 8 is a variation of FIG. 6.

FIG. 8 shows a lubrication system for a rewind and take-off elastic strip 20 corresponding to FIG. 6, except that a sleeve bearing here replaces the previous roller bearing. The strip 20 is guided between two glide shoes. The slide shoes are made of wear-resistant material. Here too the lubrication takes place at an unstressed site, approximately in front or behind the glide shoes. In another provision for lubricating at unstressed locations, the upper glide shoe and the lower glide shoe are each divided into two separate parts 24*a*, 24*b* and 25*a*, 25*b* and one solid lubricant body 13 and 18 is mounted between these parts. FIG. 8 shows the arrangement of solid lubricant bodies 13 and 18 in separate transverse planes. The design of the solid lubricant bodies proper, i.e., with guide ducts and depressing means, springs or weights, etc., can be implemented in any desired manner, for instance as described above.

It will be obvious to those skilled in the art that many modifications may be made within the scope of the present invention without departing from the spirit thereof, and the invention includes all such modifications.

What is claimed is:

1. In a weaving machine with filling-yarn insertion by means of inserters adapted to be alternatingly advanced into and retracted from the shed and being composed of long support devices having gripper systems at the ends thereof, said support devices being adapted to be driven and both supported and guided outside the shed in their rectilinear motion, and being supported between guide rollers, the improvement comprising solid lubricating means fixed with respect to the machine and in sliding contact with said advanced and retracted support devices in an unstressed part of bearing means for said support devices.

2. A weaving machine according to claim 1 including means whereby the surfaces of the solid lubricating means contacting the support devices are slightly pressed against sides of the suport devices perpendicularly to the direction of motion thereof.

3. A weaving machine according to claim 1 in which said support devices are rod means with polygonal cross-sections, said solid lubricating means resting against each side of said rod means which is guided by a bearing means and across the entire width of said side.

4. A weaving machine according to claim 3 in which the contacting surfaces of the solid lubricating means are angle-shaped and each of which at least in part covers two adjacent sides of a support device.

5. A weaving machine according to claim 3 including means whereby individual solid lubricating means for diverse sides of said rod means are mounted in different transverse planes of the support devices.

6. A weaving machine according to claim 1 including means whereby the contact pressure of the solid lubricating means is adjustable.

7. A weaving machine according to claim 1 including guidance duct means in which the solid lubricating means each are guided with slight lateral play, said guidance duct means being mounted perpendicularly to the direction of motion of the support devices.

8. A weaving machine according to claim 7 including means for adjustably mounting said guidance duct means at the bearing means in the direction of motion of the support devices.

9. A weaving machine according to claim 7 including means whereby said guidance duct means for the solid lubricating means are mounted obliquely against the sides of the support devices.

10. A weaving machine according to claim 7 in which said support devices are striplike, and said guidance duct means are located on both sides of the strip.

11. A weaving machine according to claim 10 including means mounting said solid lubricating means underneath and against the support devices which compress said lubricating means by other weights acting through reversing pulleys.

12. A weaving machine according to claim 1 including roller bearings for the support devices, said solid lubricating means being mounted between two bearing and guide rollers succeeding each other when viewed in the direction of advance of the support devices.

13. A weaving machine according to claim 1 including bearings for the support devices, said solid lubricating means being mounted in front of and behind bearing and guide rollers respectively when viewed in the direction of advance of the support devices.

14. A weaving machine according to claim 1 including sleeve bearings instead of said guide rollers for the support devices, said solid lubricating means being mounted in a discontinuity of glide shoes for the sides of the support devices.

* * * * *